US005791678A

United States Patent [19]

Perlman

[11] Patent Number: 5,791,678

[45] Date of Patent: Aug. 11, 1998

[54] ADJUSTABLE BOOT-BINDING MOUNT FOR SNOWBOARD

[76] Inventor: Richard I. Perlman, 4688 Alvarado Canyon Rd. Ste. D, San Diego, Calif. 92120

[21] Appl. No.: 658,565

[22] Filed: Jun. 5, 1996

Related U.S. Application Data

[60] Provisional application No. 60/012,626 Mar. 1, 1996.

[51] Int. Cl.[6] ..... A63C 9/02

[52] U.S. Cl. ..... 280/618; 280/14.2; 280/617

[58] Field of Search ..... 280/618, 617, 280/611, 607, 14.2

[56] References Cited

U.S. PATENT DOCUMENTS

| | | | |
|---|---|---|---|
| 4,871,337 | 10/1989 | Harris | 41/74 |
| 4,964,649 | 10/1990 | Chamberlin | 280/618 |
| 5,021,017 | 6/1991 | Ott | 441/70 |
| 5,028,068 | 7/1991 | Donovan | 280/618 |
| 5,044,654 | 9/1991 | Meyer | 280/613 |
| 5,190,311 | 3/1993 | Carpenter et al. | 280/618 |
| 5,236,216 | 8/1993 | Ratzek | 280/607 |
| 5,261,689 | 11/1993 | Carpenter et al. | 280/618 |
| 5,354,088 | 10/1994 | Vetter et al. | 280/618 |
| 5,433,636 | 7/1995 | Gillis | 441/74 |
| 5,435,080 | 7/1995 | Meiselman | 36/117 |
| 5,499,837 | 3/1996 | Hale et al. | 280/607 |
| 5,520,405 | 5/1996 | Bourke | 280/613 |
| 5,520,406 | 5/1996 | Anderson | 280/624 |
| 5,553,883 | 9/1996 | Erb | 280/618 |
| 5,577,755 | 11/1996 | Metzger et al. | 280/618 |
| 5,586,779 | 12/1996 | Dawes et al. | 280/14.2 |

FOREIGN PATENT DOCUMENTS

| | | | |
|---|---|---|---|
| 2627097 | 8/1989 | France | 280/607 |

*Primary Examiner*—Eric D. Culbreth
*Attorney, Agent, or Firm*—Fitch, Even, Tabin & Flannery

[57] ABSTRACT

An adjustable, rotatable boot-binding mount (20) includes a swivel plate (40) having threaded mounting holes (24) therein to which a conventional boot binding (60) or boot may be mounted. The swivel plate (40) is rotatably retained within a base plate (30) which is securely fastened to the top surface of a snowboard (10) or other recreational board. During normal use, the swivel plate (40) is automatically and continuously locked against rotation within the base plate (30), thereby securely maintaining the boot binding in a desired angular position relative to the snowboard. At other times, e.g., while standing in lift lines or riding a lift, a quick release mechanism (27, 48) allows the swivel plate to be temporarily unlocked so that a different angular position of the swivel plate (and hence a different angular position of the boot binding or boot) relative to the snowboard may be quickly and easily realized.

18 Claims, 4 Drawing Sheets

ADJUSTABLE BOOT-BINDING MOUNT FOR SNOWBOARD

This application claims the benefit of U.S. provisional Application Ser. No. 60/012,626, filed Mar. 01, 1996.

BACKGROUND OF THE INVENTION

The present invention relates to recreational boards, such as a snowboard, and more particularly to a an adjustable boot-binding mount with a quick release mechanism that can be attached to a recreational board for facilitating the attachment, adjustment and use of a conventional boot binding or boot with the recreational board.

A snowboard is a single board, generally wider and shorter than a snow ski, on which a rider ("snowboarder") rides down a snow-covered inclined surface. The popularity of snowboarding as a recreational sport has increased dramatically in recent years, with snowboarders generally using the same facilities and resorts that skiers use throughout the world.

In order to "ride" a snowboard, a user must bind his feet to the snowboard in some manner. Several different types of binding systems are known in the art, as represented, e.g., by the binding systems shown in U.S. Pat. Nos. 5,354,088; 5,236,216; 5,190,311; 5,044,654; 4,964,649; 4,871,337. Commercially-available boot bindings have also been developed in recent years for this purpose. Such bindings may be purchased from, e.g., Burton Inc. of Burlington, Vt.

In use, the commercially-available boot binding is typically screwed or bolted to a top surface of the snowboard using a multiplicity of threaded mounting holes arranged in a prescribed pattern on the manufactured snowboard. Two boot bindings are thus mounted, one for each leg of the user. The relative longitudinal position of the boot bindings on the snowboard is usually adjustable within certain limits by selecting a different group of holes from the pattern of available mounting holes.

Snowboard boot bindings, once mounted to the snowboard, typically include a second adjustment which allows the user (i.e., the "rider") to adjust the relative angular position of the boot binding to the longitudinal axis of the snowboard, thereby allowing the user to set the bindings to a position most comfortable to him or her as he or she rides the snowboard down a snow-covered incline. For example, if a user likes to ride with his/her left leg forward on the snowboard, then the boot binding will typically be adjusted so that the user's foot (toes) point to the user's right relative to the longitudinal axis of the snowboard. Similarly, if a user rides with his/her right leg forward, the boot binding will usually be adjusted so that the toes point to the user's left. The amount of the second adjustment, hereafter referred to as the angular adjustment of the boot binding, varies greatly as a function of individual preference.

Disadvantageously, the second adjustment, i.e., the angular adjustment of the boot binding, is not easily made, as least not when the most common commercially-available snowboard boot bindings are used. Rather, the user must typically dismount, i.e., take his or her boot out of the boot binding; unlock or disengage a plate on which the boot mounts, e.g., by loosening a screw or other capturing mechanism using a special tool; readjust the plate to a new angular position; lock or reengage the plate in its new position; and then remount, i.e., place his or her boot back into the boot binding.

Unfortunately, the above-described adjustment process—of dismounting, unlocking, adjusting, locking, and remounting—is extremely cumbersome and time-consuming to perform, particularly while on the snowboarding slope or at the snowboarding site. Because this adjustment is not easily made, many users, once the adjustment has initially been performed to their liking, refuse to make any further adjustments. Such non-adjustment may result in some rather difficult situations while snowboarding. For example, when the user is waiting in a lift line, he or she may have to "hop" in an awkward fashion, with the snowboard skewed at an awkward angle relative to his or her feet and the other individuals waiting in line, many of whom are skiers. Alternatively, the snowboarder, while waiting in a lift line, may disengage one boot from one of the snowboard boot bindings, but leave the other foot engaged to the other snowboard boot binding such that either the snowboard protrudes out from the engaged foot at an awkward angle, or he/she must maintain his foot at an awkward and uncomfortable angle. Similarly, when riding in a lift chair, the snowboard (if not completely removed from the user and hung from the back of the lift chair) typically dangles from at least one foot at an awkward angle, which awkward angle is not only uncomfortable to the snowboarder, but also may be bothersome to other lift riders.

One type of quick-action adjustable snow boot binding mounting known in the art is disclosed in U.S. Pat. No. 5,028,068, issued to Donovan. The binding mount described in the '068 patent includes an adapter plate for gluing, bolting, or otherwise fastening the adaptor plate to a snowboard top. A swivel plate is then pivotally mounted on top of the adaptor plate by a center bearing and flexible bushings (to allow flexation of the swivel plate) and a through-bolt (which serves as an axle, or pivot point for the swivel plate). The swivel plate is thus free to rotate a full 360 degrees about the pivot point. A cable extends around a circumferential edge of the swivel plate, and may be selectively tightened through the use of a conventional pull arm and handle, thereby applying a circumferential locking force around the edge of the swivel plate. Such arrangement is potentially dangerous because the pull arm and handle must be latched in its down position in order for locking to occur. A user may forget such latch down, or may attempt but not achieve latch down, in which case the swivel plate is left loose to spin freely (a very undesirable and unsafe condition). Further, the handle may pop up while the snowboard is in use, thus also unlocking the swivel plate so that it rotates at a time when the user does not want it to rotate. Hence, it is apparent that an automatic locking mechanism is needed —one that always remains locked except when the user is applying a positive manual force to achieve an unlocked position. Further, because the swivel plate extends up above the board surface, so the locking cable may be wrapped around it, snow and ice can easily become packed under the swivel plate, causing difficulties in making adjustments.

It is thus evident that improvements are needed in the manner in which angular or rotational adjustments are made to boot bindings mounted on a snowboard.

SUMMARY OF THE INVENTION

The present invention addresses the above and other needs by providing a lockable and rotatable boot-binding mount which is affixed directly to the top surface of a snowboard (or other recreational board) without the use of a locking cable or through-bolt axle, as is used, e.g., in the above-referenced '068 patent. The adjustable (i.e., "lockable" and "rotatable") boot-binding mount of the present invention includes a rotatable mounting plate mounted close to the surface of the recreational board. The adjustable mounting plate has means thereon for directly attaching a conventional or custom snowboard boot binding or boot thereto without flexation. Such arrangement advantageously affords the user more direct control of the snowboard as it is being ridden than has heretofore been available using prior art adjustable mounts.

In use, the user unlocks the rotatable mounting plate by pulling and holding a single release handle, adjusts the angular position of the mounting plate (and boot binding or boot attached thereto) to a desired position by, e.g., simply twisting or rotating his or her foot while the mounting plate is unlocked, and then releases the release handle, thereby securely locking the mounting plate in the new position. Thus, the user is able to quickly and easily make whatever angular adjustments are needed or are appropriate for the boot binding mount regardless of whether the user is waiting in a lift line, riding a lift, or snowboarding down a slope.

The lockable and rotatable boot-binding mount of the present invention comprises a rotatable mounting plate (sometimes referred to herein as a "swivel plate") which has threaded mounting holes therein to which a conventional (or custom) boot binding or boot may be directly attached. The mounting plate is rotatably retained within a circular cutout or recess of a base plate. The base plate, in turn, is securely fastened to the top surface of the snowboard or other ridable board.

In accordance with one aspect of the invention, the base plate may be mounted directly to the snowboard using the same mounting holes as would otherwise be used for direct mounting of a boot binding to the snowboard.

During normal use, the rotatable mounting plate is locked in position within the base plate by a spring-loaded locking mechanism which radially directs a locking arm into the rotatable mounting plate to prevent it from rotating, thereby firmly maintaining the rotatable mounting plate (and boot binding attached thereto) in a desired angular position. When an adjustment is needed, e.g., while standing in lift lines, riding a lift, or switching from a left-leg-forward position to a right-leg-forward position, a quick release mechanism releases the spring-loaded locking mechanism (i.e., retracts the locking arm) so that a different angular position of the rotatable mounting plate (and hence of the boot binding) may be quickly and easily realized. Once the desired angular position of the rotatable mounting plate has been achieved, then the locking mechanism is released, causing the rotatable mounting plate (and hence the boot binding) to be firmly locked in its new angular position.

The present invention may be broadly characterized as an adjustable boot-binding mount for use with a recreational board, such as a snow board, where the boot-binding mount includes four main elements: (1) a base plate; (2) means for mounting the base plate to a top surface of the recreational board; (3) a swivel (or mounting) plate mounted for rotation to the base plate, and (4) releasable locking means for radially applying a locking force to the swivel plate which prevents the swivel plate from rotating. The swivel plate has boot-binding attachment means thereon for securely mounting a boot binding thereto, whereby rotation of the swivel plate effectuates a rotation of any boot binding mounted to the swivel plate.

It is a feature of the invention to provide a rotatable-boot-binding mount for use with a snowboard, or similar recreational board, that can be quickly, easily and securely rotated to a desired angular orientation on the top surface of the snowboard.

It is another feature of the invention to provide such a rotatable-boot-binding mount wherein the rotational adjustments may be made over a full 360 degrees in small increments, e.g., six degrees or less.

It is an additional feature of the invention to provide a rotatable-boot-binding mount that can be easy installed on a snowboard, or other recreational board, without disassembly and reassembly of its various components.

It is yet a further feature of the invention to provide a rotatable-boot-binding mount for use with a snowboard or the like that is automatically securely and reliably locked in a set angular position, yet may be quickly and easily unlocked temporarily so that a new angular position may be set.

It is still another feature of the invention, in accordance with one aspect thereof, to provide a rotatable-boot-binding mount for use with a recreational board, such as a snowboard, wherein a swivel plate (or rotatable mounting plate) used with the mount remains close to the snowboard surface and does not have to extend above the surface of the snowboard in order to permit adjustment and/or locking of the plate in a new position.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
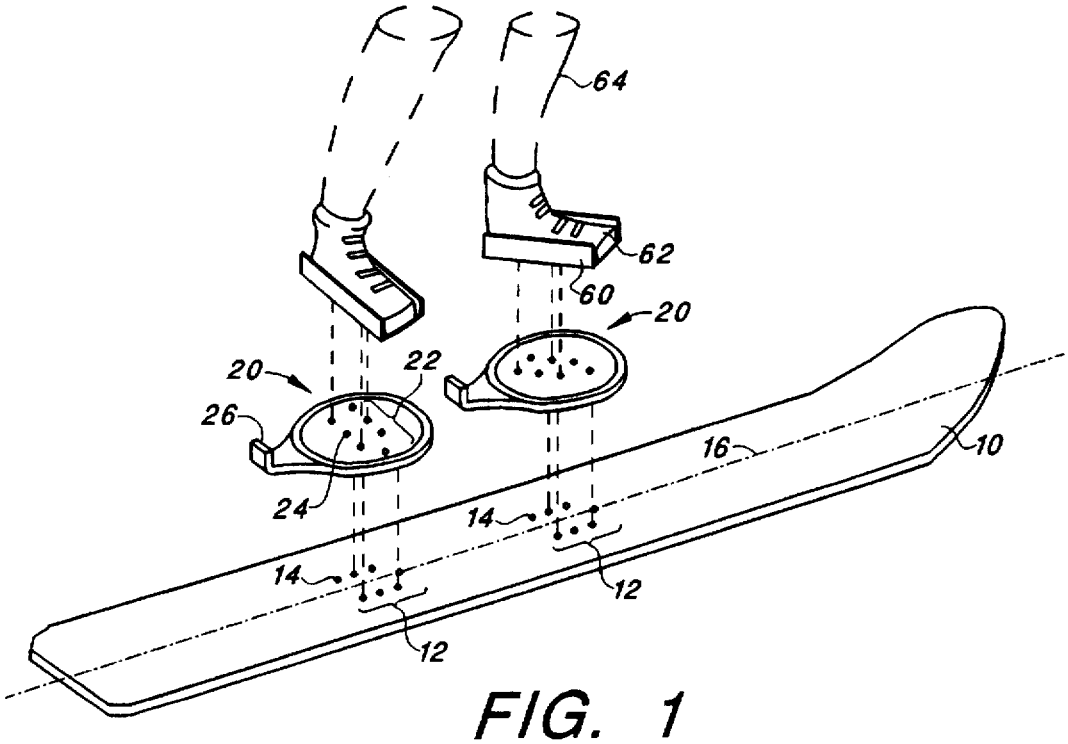
FIG. 1 is an exploded view that depicts the manner in which at least one rotatable-boot-binding mount is attached to a snowboard in accordance with the present invention.

Turning first to FIG. 1, an exploded view is shown that depicts the manner in which a pair of adjustable boot-binding mounts 20 made in accordance with the present invention may be attached to a recreational board 10, such as a snowboard. The board 10 typically includes a set of mounting holes 14 arranged in a particular mounting pattern 12. The holes 14 are usually threaded mounting holes adapted to receive a screw or bolt (not shown) that passes through a mounting hole of the mount 20.

In the absence of the present invention, a conventional boot binding 60, adapted to hold a boot 62 of a snowboard user 64, is mounted directly to the set of mounting holes 12 located on an upper surface of the snowboard 10. Such direct mounting advantageously affords the user 64 excellent control of the snowboard 10 as it is being ridden. Unfortunately, however, such direct mounting makes it very difficult to easily adjust the angular position of the bindings 60 relative to a longitudinal axis 16 of the snowboard 10, as previously discussed.

The present invention comprises an adjustable boot-binding mount 20 which can be easily mounted to the top surface of the snowboard 10 using the standard mounting holes 14 typically found on a snowboard. In the event that mounting holes 14 do not exist on the snowboard 10 to which the boot-binding mounts 20 of the present invention are to be attached, then such holes 14 can be easily added to the board 10. Alternatively, other attachment means (e.g., gluing, bonding, etc.) as are known in the art may be used to secure the mounts 20 to the board.

Once the boot-binding mounts 20 have been attached to the snowboard 10, a conventional boot binding 60 is attached to the mount. To facilitate such attachment, each mount 20 includes a pattern 24 of individual mounting holes 24 thereon that typically matches the pattern 12 of mounting holes 14 commonly found on most snowboards. Hence, it is a relatively easy task to simply screw or bolt the boot-binding 60 to the appropriate mounting holes 24 of the boot-binding mount 20.

With the boot-binding 60 attached to the boot-binding mount 20, rotational or angular adjustment of the binding 60 relative to the snowboard 10 is easily performed, as explained more fully below, by simply pulling on a release handle 26 which forms part of the mount 20. With the handle 26 pulled back to a release position, the boot-binding 60, and hence the boot 62, may be rotated a full 360 degrees by, e.g., simply having the user twist his or her foot. Once the desired angular position has been reached, then the handle 26 is released, causing the boot-binding 60 to be locked to within a small incremental amount, e.g., ±3 degrees, of the new angular position until the next adjustment is made.

It should be noted that, as shown in FIG. 1, two boot-binding mounts 20 are used, one for each foot and boot-binding 60 of the user 62. For many users, only the front mount 20 need be adjustable and lockable in accordance with the teachings of the present invention. That is, for such users, the back mount 20, once set to a given angular position, need not be changed. For other users, however, easy adjustment and locking of both the front and rear mounts 20 is desired, e.g., so that the user can easily switch between a left-foot-forward position to a right-foot-forward position.

As seen in FIG. 1, the mounts 20 are typically secured to the board 10 so that one is in a forward position and one is in a rearward position, with the mounts 20 being mounted on the board 10 so as to be aligned with the longitudinal axis 16 of the board 10 (although such alignment is not necessary for purposes of the present invention). The present invention assumes that at least one of the mounts 20, e.g., the forward mount, is adjustable and lockable as taught herein. The description of the invention that follows will thus be directed to a single boot-binding mount 20 because at least one such boot-binding mount must always be used.

Further, it should be noted that while FIG. 1 shows a boot 62 of a user 64 being mounted in a boot-binding 60 which, in turn, is mounted to the adjustable boot-binding mount 20 of the present invention, it is contemplated that the adjustable mount 20 may also be used directly with a special boot that mounts directly to the adjustable mount 20 without the need for a separate boot-binder 60. Indeed, the present invention is directed to the adjustable mount 20, regardless of the type of recreational board 10, or boot-binder 60, and/or boot 62, that may be attached thereto.

Figure 2:
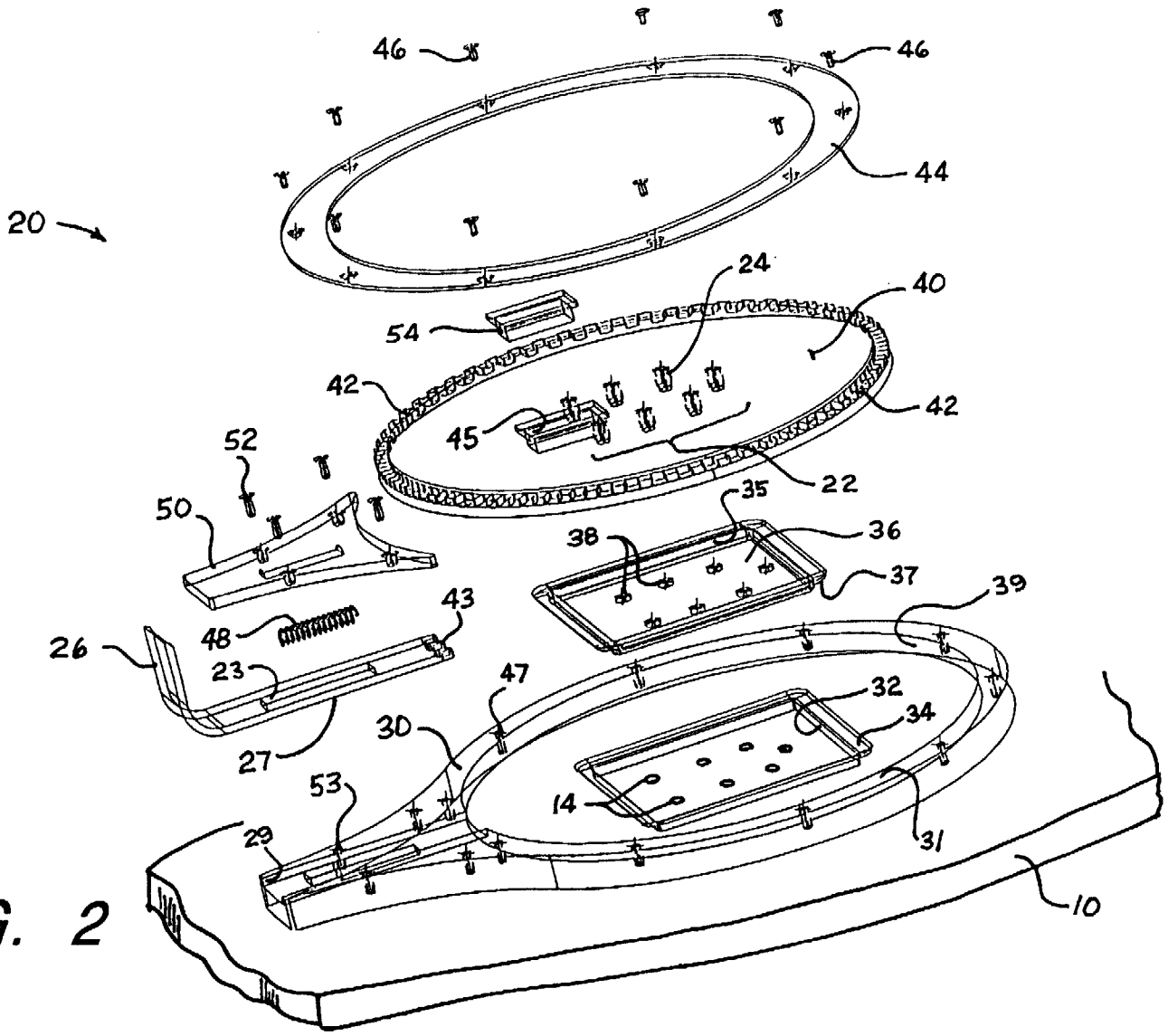
FIG. 2 is an exploded view of preferred embodiment of the rotatable-boot-binding mount of the invention.

Referring next to FIGS. 2–5, there are shown various views of a preferred embodiment of the adjustable boot-binding mount 20 of the present invention. FIG. 2 is perhaps the most instructive of these figures as it shows an exploded view of all the parts that are used within the adjustable mount 20. In describing these parts with reference to FIG. 2, reference will also be made to others of the figures so that the parts may be seen in their assembled form.

As seen in FIG. 2, the adjustable boot-binding mount 20 includes four main components: a base plate 30, a swivel plate 40 (also referred to as a rotating mounting plate 40 or simply a rotating plate 40), a retaining ring 44, and a sliding arm 27. The base plate 30 has a circular recess 39 therein having an inside diameter just slightly larger than the diameter of the swivel plate 40. Hence, the swivel plate 40 can be positioned inside of the circular recess 39 and freely rotate, although significant longitudinal or lateral movement of the plate 40 is restrained (where longitudinal movement is movement in a direction along the longitudinal axis 16, lateral movement is movement in a direction perpendicular to the longitudinal axis). Note that rotational movement of the swivel plate 40 is not dependent upon a pivot point or axle to which the plate 40 is attached at its center. Rather, the plate 40 simply may turn or rotate within the recess 39.

A rim 31, which comprises an integral part of the base plate 30, surrounds the recess 39. A retaining ring 44 is secured to the rim 31 by screws 46 or equivalent fasteners which are received in holes 47. The retaining ring 44 has an inside diameter less than the diameter of the swivel plate 40, and thus keeps the swivel plate 40 within the recess 39. In some embodiments, the retaining ring 44 may comprise an integral part of the rim 39 and base plate 30, and may not even be a ring, but may rather comprise tabs or fingers that extend over (or into a slot of) the swivel plate 40 so as to keep the plate 40 in its desired position within the circular recess of the base plate 30. Any suitable "keeper" means may be used for this purpose.

The swivel plate 40 has a pattern 22 of mounting holes 24 thereon which, in the preferred embodiment, matches the same hole pattern 12 that is typically found on a snowboard or other recreational board to which a boot-binding 60 (FIG. 1) is to be mounted. The mounting holes 24 are typically realized by placing threaded inserts into the plate 40 arranged in the desired pattern.

A key element of the present invention is the locking mechanism which is used to prevent rotation of the swivel plate 40. Such locking mechanism involves the use of a slidable arm 27 that is axially or radially forced into the perimeter of the swivel plate 40 by a radial or axial force created by coiled spring 48. (Note, as used herein, "radial" either or axial refers to a direction generally aligned with a center point of the swivel plate 40.) Locking is further secured by the use of locking teeth 42 spaced equally around the perimeter of the swivel plate 40 and corresponding engaging teeth 43 located on one end or tip of the slidable arm 27. Thus, when the slidable arm 27 is radially forced into an engagement position, as shown best in FIG. 4, and also evident from FIG. 5, the locking teeth 42 and engaging teeth 43 mesh, or engage, and rotational movement of the swivel plate 40 is prevented. However, when the slidable arm 27 is radially pulled back from the engagement position, the swivel plate 40 is free to rotate, or free to be adjusted to any desirable angular position, and then locked in the new angular position to within the angular tolerance defined by the locking teeth 42.

While any number of locking teeth 42 may be used on the swivel plate 40, a preferred number of teeth is 60. With n locking teeth 42 spaced around the entire circumference of the plate 40, the swivel plate 40 may be locked in discrete angular increments of 360/n degrees. Thus, with 60 teeth, the locked angular adjustment increment of the swivel plate 40 is 6 degrees.

Some embodiments of the invention may use locking teeth around only a desired segment of the plate 40 when it is known that angular adjustment is not needed nor desired for a full 360 degrees. Further, while the locking teeth 42 are shown in the figures as being positioned around the circumferential edge of the swivel plate 40, such circumferential teeth 42 may serve their intended function without being at the very edge of the plate 40, i.e., they may be located inward from the circumferential edge of the plate 40 at an inner radius which is less than the radius of the plate 40.

Figure 4:
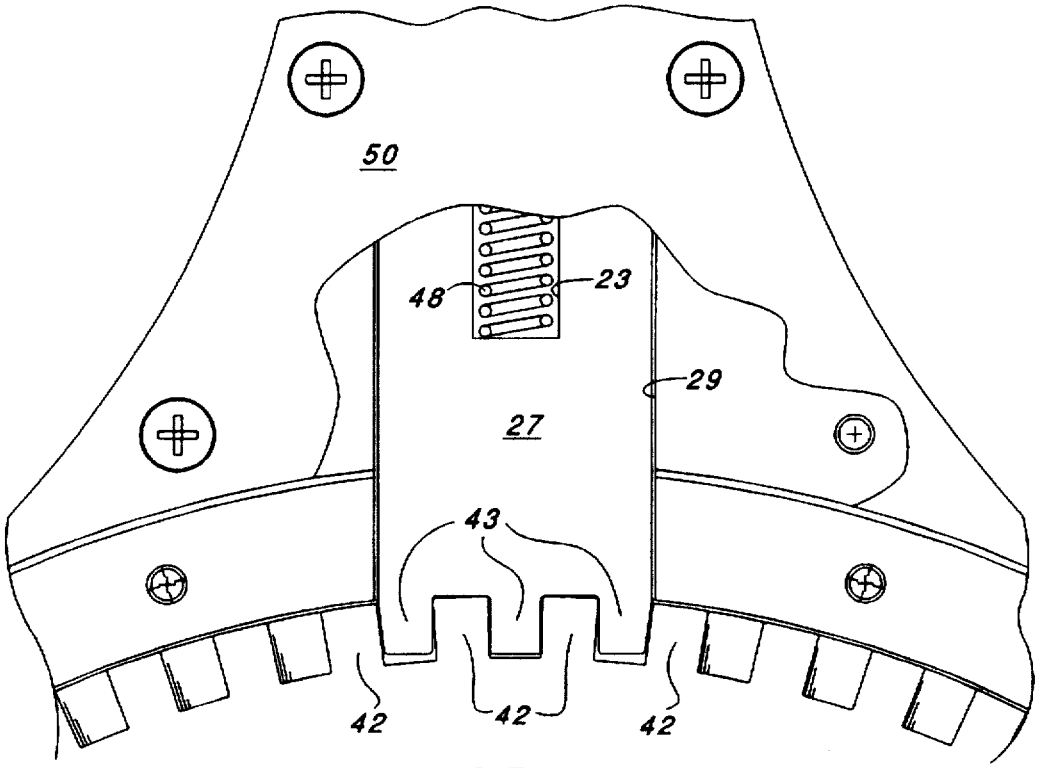
FIG. 4 is an enlarged cut-a-way top view of a portion of the rotatable boot-binding mount, showing details of the releasable locking mechanism used therewith.
Figure 5:
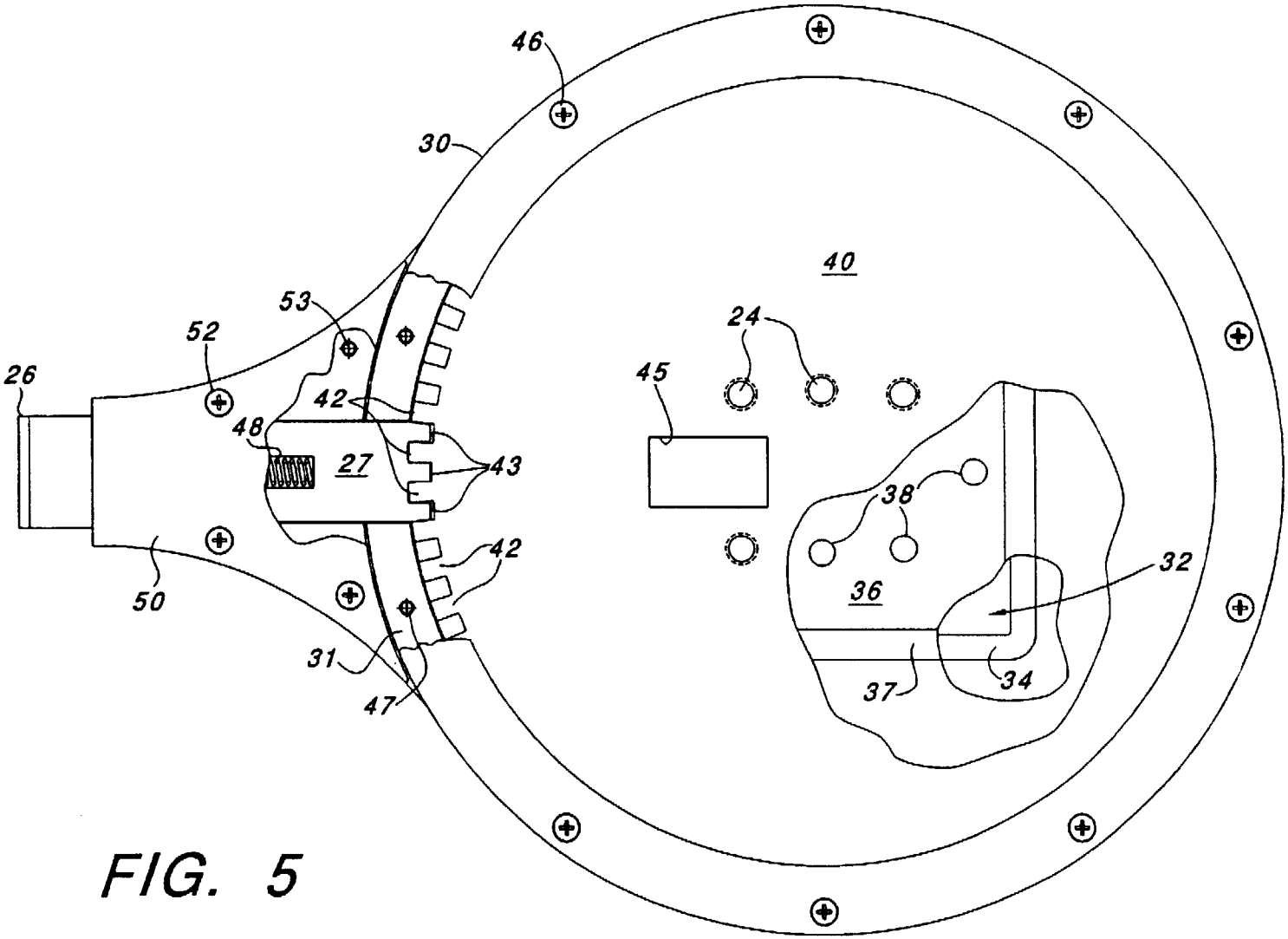
FIG. 5 is a top, partially cut-a-way, view of the rotatable boot-binding mount of FIG. 2.

As seen best in FIGS. 4 or 5, the slidable arm includes three engaging teeth 43 which mesh with four locking teeth 42. More or less engaging teeth may be used, as desired. One engaging tooth is all that is required to perform the locking function.

It should be noted that other embodiments of the invention may use locking mechanisms that use other engaging elements other than teeth. For example, holes may be inserted around a periphery edge of the swivel plate 40 into which a pin(s) may be radially inserted when locking is desired.

As seen best in FIG. 2, the slidable arm 27 is positioned within a channel 29 which is formed within the base plate 30. The arm 27 has the engaging teeth 43 at one end thereof. The other end of the arm 27 is bent up to form a handle 26. When the arm 27 is placed in the base plate channel 29, a spring 48 is also inserted into the channel 29, and more particularly positioned within a slot 23 of the arm 27. The spring is then placed in compression, with one end of the compressed spring 48 being set against a retaining surface within the channel 29, and the other end of the compressed spring being positioned to contact an end of the slot 23 of the arm 27. Thus, the force created by the compressed spring radially forces the arm 27 into its engaging position with the swivel plate 40, thereby locking the plate 40 and preventing rotation thereof. A manual force applied to the handle 26 overcomes the spring force and allows the arm to be slid back out of its engaging position, thereby freeing up the swivel plate 40 for rotation. A cover plate 50 covers the channel 29, and holds the arm 27 and spring 48 in their appropriate positions within the channel 29. The cover plate is secured to the base plate 30 using screws 52, or equivalent fasteners, received into base-plate holes 53.

Any suitable means may be employed to attach the base plate 30 to the top surface of the snowboard 10 providing such attachment means do not interfere with the rotation or locking of the swivel plate 40. For example, suitable holes placed in the bottom of the recess 39 of the base plate 30, counterbored as required to allow heads of the screws or bolts to be positioned below a bottom surface of the recess 39, could be used.

Figure 3:
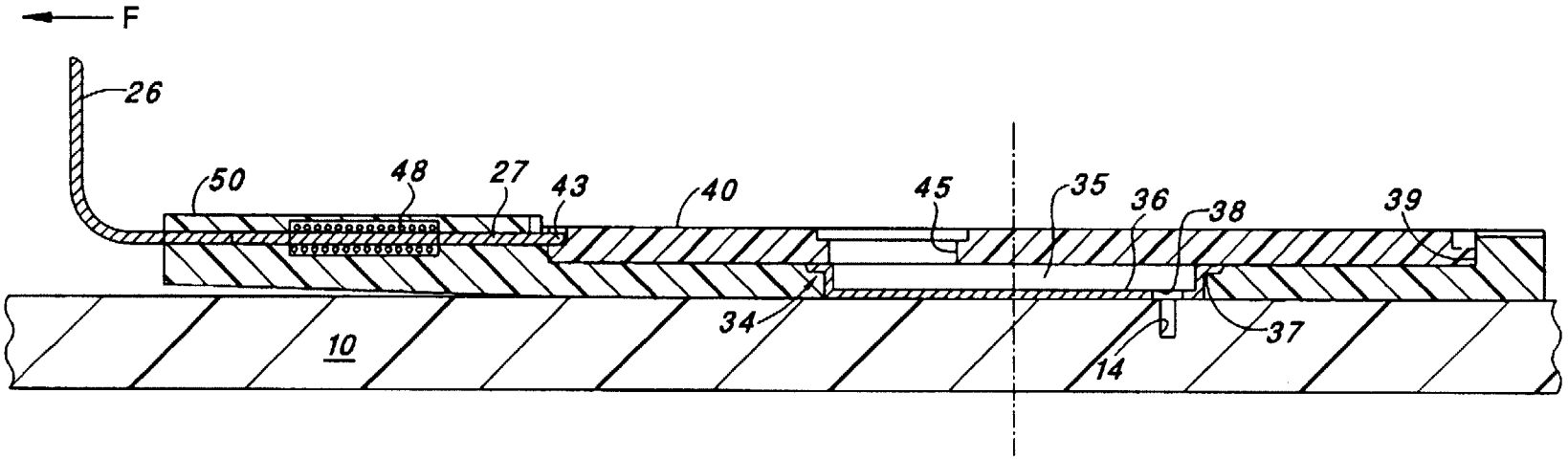
FIG. 3 is a partial side sectional view of the rotatable boot-binding mount of FIG. 2.

A preferred means of attachment for the base plate 30, especially when the base plate 30 is made from plastic, is to make an opening 32 in the bottom of the recess 39, which opening is generally of sufficient size to fully expose the mounting hole pattern 12 of the snowboard 10. The opening 32 has a recessed shoulder 34 around its perimeter. A mounting or attachments plate 36, typically a die-cut, stamped, metal plate of a size designed to fit within the opening 32, has holes 38 in a bottom surface therethrough arranged in a pattern which is compatible with the hole pattern 12 found on the surface of the snowboard 10. The mounting plate 36 also has a ridge 37 around its perimeter designed to rest upon the shoulder 34 surrounding the opening 32. (See FIGS. 3 and 5.) As seen in FIG. 3, the bottom surface of the mounting plate 36 rests upon the surface of the board 10 at the same time that the ridge 37 rests on the shoulder 34. Thus, by securing the bottom surface of the attachment plate 36 to the snowboard 10 by inserting bolts or screws (not shown) through the holes 38 of the attachment plate 36 into the mounting holes 14 of the snowboard 10, the entire base plate 30 is tightly secured or fastened to the snowboard 10. Moreover, as seen in FIG. 3, because the mounting or attachment plate 36 is typically a stamped metal part, shaped like a trough, or a rectangular cake pan, with its mounting or bottom surface being below the ridge 37 which engages the shoulder 34 of the opening 32, a void or space 35 is created within the opening 32 where the heads of the bolts or screws used to fasten the attachment plate 36 to the board 10 may reside without interfering with the rotation of the swivel plate 40.

Use of the mounting or attachment plate 36, as described above, facilitates the mounting of the base plate 30 particularly when the base plate 30 is made from a thin, lightweight, material, e.g., plastic, which may not be conducive to having counterbored holes placed therethrough. Also, such plate 36 allows a wide variety of different types of recreational boards 10 using different hole patterns to be used. As different hole patterns are encountered, a different attachment plate 36 may be provided which includes a new or different hole pattern without having to alter or modify other components of the adjustable boot-binding mount 20, thereby keeping manufacturing and retro-fitting expenses at a minimum.

Further, it is noted that by providing a hole pattern in the attachment plate 36 that includes seven holes, as shown in FIG. 2, most of the commonly used hole patterns currently found on snowboards, and currently used with most commercially known boot-bindings, will be alignable with at least three of the holes of the seven hole pattern.

To further facilitate attachment of the base plate 30 to the board 10 without having to disassemble the boot-binding mount 20 (i.e., without having to remove the retaining ring 44 and the swivel plate 40), an access slot 45 is provided through the plate 40. Such access slot 45 selectively provides access from the top side of the mount 20 to each of the holes 38 of the attachment plate 36 as the swivel plate 40 is rotated. Thus, when the mount is mounted to the board 10, a conventional wrench, nut driver, or other suitable tool may be readily used through the access slot 45, rotating the swivel plate as needed to expose the desired hole 38, to secure and tighten each of the bolts or screws which are used to attach the attachment plate 36 to the board 10. A removable access cover plate 54 may also be used, as desired, to cover or close the access slot 45 once the mounting has been completed.

An advantage of the present invention, as best seen in the side-sectional view of FIG. 3, is that the swivel plate 40 is located close to the surface of the snowboard 10, thus approximating the same feeling and control that a user achieves when the boot-binding 60 (FIG. 1) is mounted directly to the board 10. (Note, the retaining ring 44 has been omitted from FIG. 3.)

In general, the parts of the adjustable boot-binding mount 20 of the invention described above in connection with FIGS. 2–5 may be made from many different types of materials, including many different types of metals (e..g, aluminum or aluminum alloys), plastics, rubber, ceramics and/or other synthetic/composite materials.

As an additional advantage of the invention, all of its parts, e.g., the base plate 30, the swivel plate 40, retaining ring 44, slidable arm 27, cover 50, attachment plate 36, etc., do not have to be machined parts that require a precision fit one with another in order for the invention to perform its intended and desired function. Tolerances on the order of ±0.03125 inches (±1/32 of an inch), for example, may readily be accommodated for these parts without degrading in any way the operation of the adjustable mount. Such tolerances can readily be achieved without machining using conventional molding, stamping, and/or die cut metal techniques, as is known in the art. Such construction allows the cost of making the invention to be kept relatively low.

As described above, it is thus seen that the invention provides a adjustable boot-binding mount for use with a snowboard, or similar recreational board, that can be quickly, easily and securely rotated, over a full 360 degree range, to a desired orientation on the top surface of the snowboard.

It is further seen that the invention provides an adjustable boot-binding mount that can be inexpensively manufactured, and that may be easy installed on a snowboard, or other recreational board, without disassembly and reassembly of its various components.

While the invention herein disclosed has been described by means of specific embodiments and applications thereof, numerous modifications and variations could be made thereto by those skilled in the art without departing from the scope of the invention set forth in the claims.

What is claimed is:

1. An adjustable boot-binding mount (20) for attachment to a recreational board (10) to which a boot binding (60) may be attached, comprising:

a base plate (30) having a circular recess (39) therein, said circular recess being surrounded by a base plate rim (31);

means for mounting the base plate to a top surface of the recreational board comprising an opening (32) located centrally in the circular recess (39), said opening (32) having a shoulder recess (34) around the perimeter thereof, the top surface of the recreational board being accessible through the opening (32), an attachment plate (36) sized to fit within the opening (32), said attachment plate having a rim (37) adapted to engage the shoulder recess (34) when the attachment plate is placed within the opening (32), and means for detachably securing the attachment plate (36) to a top surface of the recreational board (10);

a circular swivel plate (40) positioned within said circular recess, said swivel plate having a diameter less than the diameter of the circular recess, whereby the swivel plate may rotate within said circular recess;

retaining means secured to the rim (31) of the base plate for retaining the swivel plate within the circular recess; and releasable locking means for locking rotation of the swivel plate within the recess comprising a set of perimeter teeth (42) spaced around the swivel plate (40), a slidable arm (27) attached to the base plate (30), said arm having a first end with at least one engaging tooth (43) thereon adapted to engage the perimeter teeth of the swivel plate when the slidable arm has moved to a locked position, bias means (48) for forcing and holding the slidable arm (27) in its locked position, and a handle (26) at a second end of the arm (27) to which a manual force (F) opposing the force of the bias means may be applied, whereby the bias means may be manually overcome to slide the arm away from the perimeter teeth, thereby unlocking the swivel plate and allowing it to rotate within the circular recess of the base plate;

said swivel plate having means for attaching the boot binding thereto, whereby rotation of the swivel plate effectuates a rotation of the boot binding and any boot mounted thereto, thereby providing a user of the recreational board with a lockable and rotatable boot-binding mount; and wherein said handle (26) is manually accessible when a boot is mounted on the boot binding attached to the swivel plate, whereby the swivel plate may be rotated by manually releasing the handle and twisting the boot attached to the boot binding.

2. The boot-binding mount of claim 1 wherein the set of perimeter teeth (42) extend completely around the swivel plate (40), whereby the swivel plate may be rotated and locked over a full 360 degree rotation.

3. The boot-binding mount of claim 2 wherein the set of perimeter teeth (42) include sixty teeth, whereby the swivel plate may be rotated and locked in six degree increments.

4. The boot-binding mount of claim 2 wherein the slidable arm (27) includes a multiplicity of engaging teeth (43) adapted to engage a multiplicity of the perimeter teeth (42) of the swivel plate (40).

5. The boot-binding mount of claim 2 wherein the base plate (30) includes a channel (29) wherein the slidable arm (27) and bias means (48) are placed, and a cover plate (50) that covers the channel (29) and holds the slidable arm (27) and bias means (48) in their proper position within the channel (29).

6. The boot-binding mount of claim 1 wherein the means for detachably securing the attachment plate (36) to a top surface of the recreational board (10) comprises a set of holes (38) arranged in a pattern on the attachment plate (36) corresponding to a pattern of threaded holes (14) found on the top surface of the recreational board (10), whereby screws or bolts may pass through the set of holes (38) and be detachably secured to the threaded holes (14) of the recreational board (10).

7. The boot-binding mount of claim 6 further including a trough (35) formed in the attachment plate (36), said trough having a depth sufficient to receive a head of a screw or bolt used to attach the attachment plate to the recreational board.

8. The boot-binding mount of claim 6 wherein the swivel plate (40) further includes an access slot (43) sized to provide access to each hole of the set of holes (38) of the attachment plate (36) as the swivel plate is rotated, whereby screws or bolts may be inserted through the holes of the attachment plate without disassembly of the boot-binding mount.

9. The boot-binding mount of claim 8 further including a removable access slot cover (54) adapted to close the access slot (43).

10. The boot-binding mount of claim 1 wherein said retaining means comprises a retaining ring (44) fastened to the rim (31) of the base plate (30), said retaining ring (44) having an inside diameter less than the diameter of the swivel plate (40) such that the retaining ring (44) covers the perimeter teeth (42) of the swivel plate (40).

11. An adjustable boot-binding mount for use with a recreational board comprising:

a base plate;

an opening located in the base plate, said opening having a shoulder around the perimeter thereof, a top surface of the recreational board being accessible through the opening, an attachment plate having a rim adapted to engage the shoulder (34) when the attachment plate is placed over the opening, and means for detachably securing the attachment plate to the top surface of the recreational board;

a swivel plate mounted for rotation within the base plate, and releasable locking means for continuously applying an axial locking force to the swivel plate which prevents the swivel plate from rotating, said swivel plate having boot attachment means thereon for securely mounting a boot thereto, whereby rotation of the swivel plate effectuates a rotation of any boot mounted thereto, and release means manually accessible without having to remove the boot from the boot attachment means for applying a manual force to overcome the continuous axial force applied by the locking means.

12. The adjustable boot-binding mount of claim 11 wherein the base plate includes a circular recess, and wherein the swivel plate comprises a circular plate sized to fit for rotational movement within the circular recess, and further wherein the base plate includes keeper means for retaining the swivel plate within the circular recess of the base plate.

13. The adjustable boot-binding mount of claim 12 wherein the circular swivel plate has a set of circumferential locking teeth; and wherein said releasable locking means comprises an arm having a tip and means for sliding the arm into an engagement position wherein the tip of said arm engages the circumferential locking teeth of the swivel plate, said arm being mounted for longitudinal movement within the base plate; whereby said circular swivel plate is locked against rotation whenever the arm is slid into its engagement position; and is not locked, and is thereby free to rotate, whenever the arm is retracted from its engagement position.

14. The adjustable boot-binding mount of claim 13 further including biasing means for continually forcing the arm to slide into engagement with the locking teeth, said arm further including a handle to which a manual force may be applied to overcome the biasing means and retract the arm from engagement with the locking teeth.

15. The adjustable boot-binding mount of claim 14 wherein the circular swivel plate includes n locking teeth equally spaced a round a circumference of the circular swivel plate, where n is an integer, any one of which n locking teeth may be engaged with the slidable arm, whereby the circular swivel plate may be rotated and locked in increments of 360/n degrees.

16. The adjustable boot-binding mount of claim 15 wherein n comprises at least sixty.

17. The adjustable boot-binding mount of claim 15 wherein the slidable arm includes a plurality of engaging teeth at its tip to engage a plurality of locking teeth of the circular swivel plate when the arm is positioned in its engagement position.

18. The adjustable boot-binding mount of claim 17 wherein the slidable arm includes at least three engaging teeth at its tip.

* * * * *